US005265360A

United States Patent [19]

Reiss et al.

[11] Patent Number: 5,265,360

[45] Date of Patent: Nov. 30, 1993

[54] WINDOW VIEW ASSEMBLY

[76] Inventors: Robert W. Reiss; Christian F. Reiss, both of 51 Abbott Rd., N. Reading, Mass. 01864

[21] Appl. No.: 803,021

[22] Filed: Dec. 6, 1991

[51] Int. Cl.[5] ..... A47F 11/06

[52] U.S. Cl. ..... 40/427; 40/579; 40/152.2; 52/38; 362/125

[58] Field of Search ..... 40/427, 575, 577, 579, 40/580, 152, 152.2, 442; 52/27, 38; 362/125; 472/57, 63, 137

[56] References Cited

U.S. PATENT DOCUMENTS 1,607,922 11/1926 Schweitzer ..... 326/125
2,139,281 12/1938 Oliver ..... 40/442
2,220,262 11/1940 Miller ..... 40/152.2
2,731,749 1/1956 Tarzian ..... 40/577 X
3,790,772 2/1974 Newman et al. ..... 40/577 X

*Primary Examiner*—Kenneth J. Dorner
*Assistant Examiner*—Brian K. Green
*Attorney, Agent, or Firm*—Don Halgren

[57] ABSTRACT

A portable window view decoration assembly for the enhanced perspective representation of decorative scene including a window frame having an enclosed housing attached to its backside. The housing has several angled panels on which are decorative scenes. The scenes are enhanced by their being displayed on the angled panels, and because a window sash is arranged in the window frame in front of the scene, adding to the depth , reality and sense of perspective of that scene.

9 Claims, 2 Drawing Sheets

WINDOW VIEW ASSEMBLY

BACKGROUND OF THE INVENTION

1. Field of the Invention

This invention relates to wall hangable decorations, and more particularly to a window frame assembly, having a decoration therein that accentuates a perspective presentation, and which assembly can be emplaced on a wall for decorative considerations.

2. Prior Art

Decorative hangings, such as pictures or photographs only present representations in two dimensions. They may of course show scenes of three dimensional characteristics. This however does not realistically represent those scenes.

Other decorative assemblies may comprise a box-like housing behind a frame, to give a depth to the viewer.

These all fail to deliver an actual three dimensional scene while accentuating the perspective sensation to that representation. Additionally, a typical three dimensional scene is not readily movable or hangable on a wall or able to act as a window where a window does in fact not exist or would be unable to exist, such as in a basement wall or in an inner wall of a home or apartment.

It is thus an object of the present invention to provide a movable wall decoration that presents to the viewer an enhanced perspective representation of a decorative scene.

It is a further object of the present invention to provide a window-like assembly with views that can be changed to suit the requirements of the viewer.

It is a further object of the present invention, to provide a unique structure to a window-like decoration, which will accentuate the perspective characteristics of the view.

It is yet a further object of the present invention to provide a structure, the physical parameters of which contribute to the enhanced perspective representation of its scenes.

BRIEF SUMMARY OF THE INVENTION

The present invention comprises a window view assembly capable of being hung on a wall, much like a picture or photograph, or which could be built into a wall, much like a window frame typical in outer walls of buildings.

The window view assembly comprises an outer most window frame consisting of a rectangular facia or trim, the lower horizontal portion of which is a window sill. The window frame assembly may have an upper and lower sash, each of which may be divided into a plurality of lights.

The window frame assembly has a backside which comprises a housing enclosure. This housing enclosure has a pair of sidewalls, an upper wall and a lower wall, each of which is contiguous to the frame or facia components of the window assembly. A rectangularly shaped rear wall is disposed across the back edge of the side, upper and lower walls, and is attached thereto.

A central strut is arranged vertically down the middle of the back wall on the inside of the housing. The central strut has a forwardly directed planar face. The central strut has an angularly disposed groove extending vertically along each side edge thereof.

Each side component of the facia trim has an inner rearwardly directed corner along which a correspondingly angularly disposed groove is emplaced. Thus, one groove on one side of the central strut is arranged to extend in the same plane as its corresponding groove in its adjacent facia trim component.

A rectangular panel is slidably disposable into each pair of the opposed grooves, (when the upper wall is removed). The rectangular panels would then be angled with respect to the back wall or the window sashes of the window frame assembly.

A trapezoidally shaped panel is slidable into an angled reclining position against the rectangular panels. The trapezoidal panel has a lower edge which extends the full width of the sash and has an upper edge which extends only the width of the central strut. The trapezoidal panel has a vertical height, when in its inclined orientation, of about one-fourth to about one-third the vertical height of the window assembly.

Each of the angularly disposed rectangular side panels may have openings therethrough, to represent a feature of a scene to be displayed.

The trapezoidal inclined panel has a graphical/pictoral drawing to represent a feature in perspective. Each angularly disposed side panel may have graphical/pictoral drawings showing further features in perspective.

The rectangular panels may be replaced by other panels having different decorative scenes painted therein, by merely removing the top wall, and sliding out the panels from their grooves and replacing them with new scenes. The lower trapezoidally shaped panel would preferably be changed as well, to comport with any new decoration or scene on the main rectangular panels.

An illumination circuit is disposed in the backside of each of the angularly disposed side panels. The illumination circuit emits light, when energized, to show through the openings in each of the side panels, to depict lights in buildings, stars, the moon or the like.

The sashes across the trim of the window assembly contributes to the sensation of depth and three dimensionality to this decoration. Each of the side panels, and the lower trapezoidal panel, being angularly disposed with respect to the viewer and to the window frame also contributes to this sensation of depth and enhanced perspective representation of this assembly.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENTS

Figure 1:
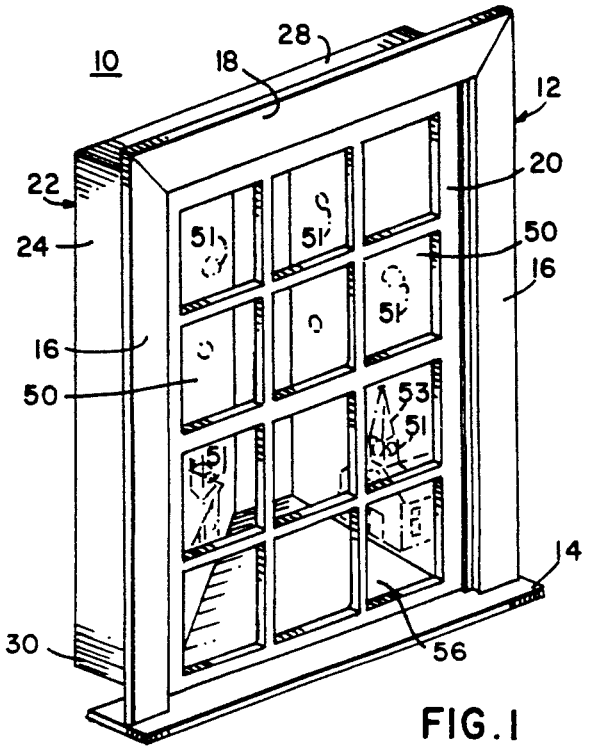
FIG. 1 is a perspective view of a decorative window frame assembly constructed according to the principles of the present invention.

Referring now to the drawings in detail, and particularly to FIG. 1, there is shown a decorative window view assembly 10, capable of being hung, picture-like, on a wall, or built into a wall, much like a regular "see-through" window.

The decorative window view assembly 10 comprises an outermost window frame 12 consisting of a rectangular facia or trim, the lower portion of which is a window sill 14, the side portions being side facia boards 16, and a top facia board 18.

The window view assembly 10 may have an upper and a lower sash, but for simplicity of construction and explanation, a multi-light single sash 20 is shown in the drawings.

The window view assembly 10 has a backside which comprises a housing enclosure 22. This housing enclosure comprises a pair of sidewalls 24 and 26, an upper-wall 28 and a base 30, each of which is contiguous to the outermost window frame 12. A rectangularly shaped panel 32 comprising the back wall, is disposed across the back edge of the side walls 24 and 26, the upper wall 28 and the base 30.

An elongated central strut 40 is attached to the front facing side of the back panel 32. The central strut 40, is vertically disposed on the middle of that panel 32, as shown in FIGS. 2, 3, 4 and 6. The central strut 40 has a forwardly directed planar face 42. An elongated groove 44 extends along each corner at the side edges of the planar face 42. The groove 44 is disposed at an oblique angle with respect to the back panel 32, and is directed generally towards its respective side facia board 16, as may be seen in FIG. 5.

Each side facia 16 may have an elongated backing component board 46 which also has a vertically extending elongated groove 48 running therealong, or the groove may be vertically arranged in the front inside edges of the walls 21 and 26. Each groove 48 is parallel to and faces its associated corresponding groove 44 on its respective side of the central strut 40, as may be seen in FIG. 5.

Figure 5:
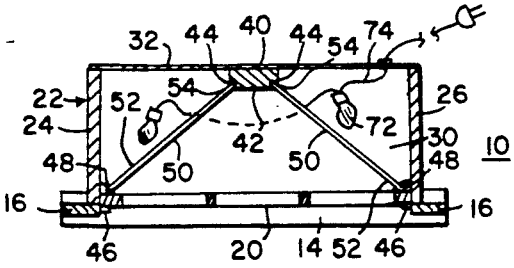
FIG. 5 is a view taken along the lines 5—5 of FIG. 2.
Figure 6:
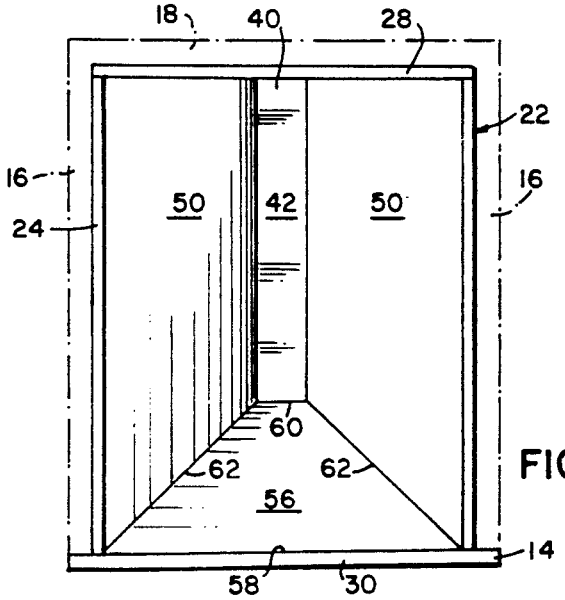
FIG. 6 is a front view of the window frame assembly without any window sash therein.

A rectangular decorative panel 50, having a pair of parallel sides 52 and 54, mate within each pair of corresponding grooves 48 and 44 respectively, as may be seen in FIG. 5. Each rectangular panel 50 also extends from the base 30 to the upper wall 28. Each rectangular panel 50 is arranged for decorative function. They are preferably disposed at an angle of about 20 to about 40 degrees with respect to the sash 20 and back panel 32.

Figure 2:
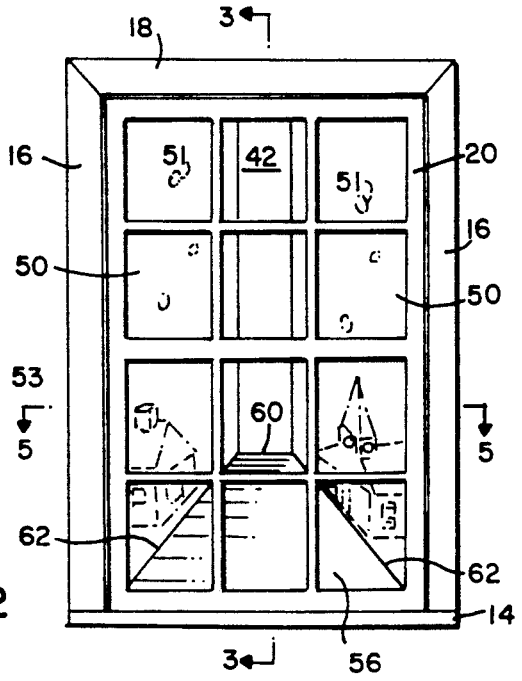
FIG. 2 is a front view of the decorative window frame assembly with a window sash in the frame.
Figure 3:
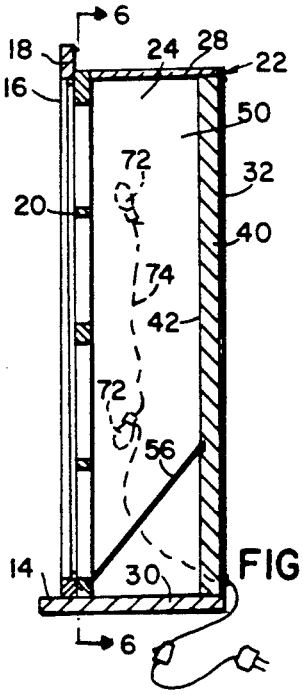
FIG. 3 is a view taken along the lines 3—3 of FIG. 2.
Figure 4:
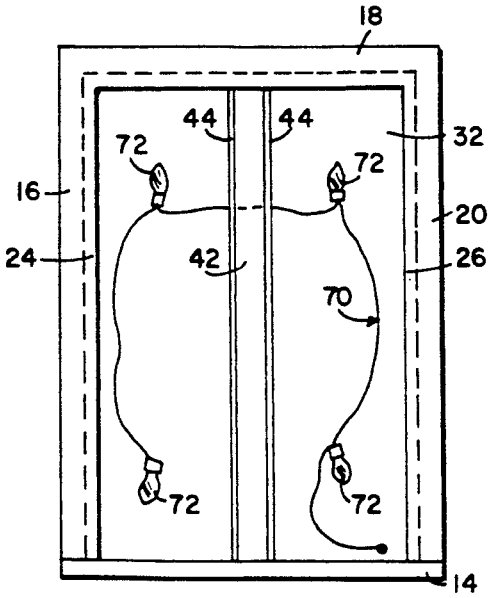
FIG. 4 is a front view of the decorative window frame assembly without any sashes or decorative panels therein.

A lower trapezoidally shaped panel 56 is slidable into an inclined orientation, reclining against the rectangular decorative panels 50, as shown in FIGS. 1, 2 and 3. The trapezoidally shaped panel 56 has a lower edge 58 which extends along the full width of the sash 20, and has an upper horizontally disposed edge 60, which extends only the width of the planar face 42 of the central strut 40. The trapezoidal panel 56 has a pair of non-parallel sides 62 and 62 which lie against the front face of the rectangular panels 50, as shown most clearly in FIG. 6. The trapezoidal panel 56 has a height of about one-fourth to about one-third of the height of the assembly 10, as may be seen in FIGS. 2 and 3.

Each of the rectangular decorative panels 50 may have openings 51 therethrough, to represent the moon, stars or lit windows as part of a building, character or FIG. 53, painted or represented on the front side of each panel 50, as shown in FIGS. 1 and 2.

An illumination circuit 70, having several light bulbs 72 disposed in a wire 74 between the back of the decorative panels 50 and the back panel 32 on the housing 22. The wire 74 may have a switch and plug to enable standard empowerment of the bulbs 72.

The trapezoidally shaped panel 56 preferably also has a graphical/pictoral scene 57 depicted thereon, such as for example, a street or lane, a sidewalk or the like, in a perspective representation, to show depth of a "fading away" view. The inclination of the trapezoidal panel 56 significantly contributes to the representation of depth and perspective as do the other angled panels 50.

The angled side rectangular panels 50, have perspective drawings thereon, in conjunction with the aforementioned openings 51 therethrough, to represent features of the scene 53, which include such lights, stars, moon, or windows in the scene painted on the panels 50.

The panels 50 may be replaced by other panels 50 having different decorative scenes painted thereon, by merely removing the top wall 28, and sliding out the panels 50 from their respective grooves 44 and 48 and replacing them with new panels containing new scenes. The lower panel 56 would be changed as well, to comport with any new decoration or scene on the changed main rectangular panels 50.

The angled panels 50 as well as the inclined lower panel 56, in critical conjunction with the sash 20 arranged in front thereof, contribute to the sensation of depth and enhanced perspective of the scene 53 viewed through the window assembly 10.

The sides 62 and 62 of the lower panel 56 contribute to the effect of perspective and depth which one would view out an actual window, thus representing a simulated view from a window assembly which can be movably hung on a wall to represent a window, or it can be built into a wall to give a simulation of a real window with an actual view therethrough.

We claim:

1. A portable window view decoration assembly for the enhanced perspective and three-dimentional presentation of a decorative scene, comprising:

a window frame assembly having a front side, a back side and a sill;

a housing enclosure attached to the back side of said window frame assembly;

an arrangement of panels obliquely angularly disposed in said housing enclosure with respect to said front side of said window frame assembly and adapted so as to be viewable from the front side of said window frame assembly, said panels having artistic decorations thereon, the angularity of said panels contributing to the three-dimensionality of the artistic decorations depicted on said panels;

said housing enclosure including a pair of side walls, an upper wall, a base, and a back wall;

said back wall including a vertically disposed central strut attached thereto, said central strut having a front facing planar surface which is arranged to receive decorations thereon; and said central strut having longitudinal grooves along its side portions.

2. A portable window view decoration assembly as recited in claim 1, wherein said window assembly includes vertical members on each side thereof, said vertical members having elongated grooves which are directed towards said longitudinal grooves in said central strut.

3. A portable window view decoration assembly as recited in claim 2, wherein a rectangular panel is disposed in each of said opposed pair of parallel grooves, said rectangular panels each defining a generally front facing obliquely disposed planar surface which is adaptable to receive decorations thereon.

4. A portable window view decoration assembly as recited in claim 3, including a trapezoidally shaped lower panel having a lower edge disposable along said sill of the window frame assembly, and an upper edge disposable across the front facing planar surface of said strut, and non-parallel side edges disposable across said obliquely disposed rectangular panels, said trapezoidally shaped lower panel defining an inclined planar surface which is arranged to receive decorations thereon.

5. A portable window view decoration assembly as recited in claim 3, including a light source arranged between said rectangular panels and said back wall of said housing enclosure.

6. A portable window view decoration assembly as recited in claim 5, including a plurality of openings arranged through said rectangular panels so as to permit light from said light source therebehind to shine therethrough, as part of any decorations on said arrangement of angularly disposed panels, enhancing the prespective representational effect of scene on said panels.

7. A portable window view decoration assembly as recited in claim 5, including a window sash arranged across said window frame assembly, to further effectuate the perspectiveness and depth effect of said obliquely angularly disposed panels by having the sash thereinfront.

8. A portable window view decoration assembly for the enhanced perspective representation of a changeable decorative scene, comprising:

a window frame assembly having a rectangular periphery, including a sill, said frame assembly having a front side and a back side;

a housing enclosure attached to the back side of said window frame assembly;

a plurality of obliquely angularly disposed planar panels replaceably secured within holding means of said housing enclosure and the back side of said window frame assembly, said obliquely angularly disposed panels having decorative scenes displayed thereon, said panels being obliquely angularly arranged so as to contribute to a three-dimensional depth presentation;

said panels being removably arranged within said holding means so as to permit said scenes to be changed when desired;

said holding means comprising a pair of parallel opposed grooves which are arranged so as to receive said panels therebetween; and said housing enclosure also containing a trapezoidably shaped planar panel angularly inclined against said panels across their lower portion, to supplement the depth of field effect when looking through said window frame assembly of a decorative scene therebeyond.

9. A portable window view decoration assembly as recited in claim 8, wherein said panels have openings therethrough, and said enclosure housing has a light source therewithin to permit light to shine from a back side of said housing enclosure through said window frame assembly to increase the decorative and perspective effect of said assembly.

* * * * *